US007617560B2

(12) United States Patent
Argo et al.

(10) Patent No.: US 7,617,560 B2
(45) Date of Patent: Nov. 17, 2009

(54) COMPACT COLLAPSIBLE SQUEEGEE

(75) Inventors: Randy Argo, 358 E. Bonita Ave., San Dimas, CA (US) 91773; Michael Clifford, San Dimas, CA (US)

(73) Assignee: Randy Argo, San Dimas, CA (US)

( * ) Notice: Subject to any disclaimer, the term of this patent is extended or adjusted under 35 U.S.C. 154(b) by 7 days.

(21) Appl. No.: 11/466,512

(22) Filed: Aug. 23, 2006

(65) Prior Publication Data

US 2007/0044264 A1 Mar. 1, 2007

Related U.S. Application Data

(60) Provisional application No. 60/710,681, filed on Aug. 23, 2005.

(51) Int. Cl.
*A47L 1/06* (2006.01)

(52) U.S. Cl. ..... 15/245; 15/121; 15/144.1; 15/144.4; 15/220.1

(58) Field of Classification Search ..... 15/245, 15/121, 144.1, 144.4, 220.1
See application file for complete search history.

(56) References Cited

U.S. PATENT DOCUMENTS

| | | | | | |
|---|---|---|---|---|---|
| 1,827,121 | A * | 10/1931 | Trane | 15/121 |
| 1,838,158 | A * | 12/1931 | Schwartz | 15/220.1 |
| 2,896,241 | A * | 7/1959 | Cotman | 15/184 |
| 3,395,415 | A * | 8/1968 | Leland | 15/121 |
| 3,413,675 | A * | 12/1968 | Westrum | 15/245 |
| 3,568,237 | A * | 3/1971 | Rhodes | 15/244.2 |
| 4,339,838 | A * | 7/1982 | Pekarek | 15/245 |
| 4,727,986 | A * | 3/1988 | Feldstein | 206/229 |
| 4,893,370 | A * | 1/1990 | Klotz | 15/121 |
| 5,255,405 | A * | 10/1993 | Samuelsson et al. | 15/144.1 |
| 5,802,661 | A * | 9/1998 | Miller et al. | 15/250.41 |
| 5,967,152 | A * | 10/1999 | Rimkus | 132/308 |
| 6,393,646 | B1 * | 5/2002 | Beers et al. | 15/144.4 |
| 6,546,596 | B2 * | 4/2003 | Grote et al. | 16/429 |
| 7,260,864 | B1 * | 8/2007 | Morad | 15/116.2 |
| 2002/0078519 | A1 * | 6/2002 | Boothby | 15/121 |
| 2004/0226126 | A1 * | 11/2004 | Cox et al. | 15/245 |
| 2004/0244205 | A1 * | 12/2004 | Linn et al. | 30/159 |
| 2005/0097691 | A1 * | 5/2005 | Tsuchiya et al. | 15/144.4 |
| 2005/0223562 | A1 * | 10/2005 | Pardue et al. | 30/161 |
| 2006/0254009 | A1 * | 11/2006 | Tsai et al. | 15/121 |

* cited by examiner

*Primary Examiner*—Joseph J Hail, III
*Assistant Examiner*—Robert Scruggs
(74) *Attorney, Agent, or Firm*—Canady & Lortz LLP; Bradley K. Lortz

(57) ABSTRACT

A compact collapsible squeegee for wiping fluids from smooth surfaces including a telescoping handle having a hinged joint at one end and a wiper support attached to the hinged joint to pivot from a closed position with the wiper support substantially parallel to the telescoping handle to an open position with the wiper support substantially perpendicular to the telescoping handle. Latches may be used to secure both the telescoping handle and the wiper support in the open position such that the squeegee is substantially rigid in use. Both the telescoping handle and the hinged joint may be spring-loaded to automate deployment of the squeegee to the open position. The telescoping handle and wiper support may be stored in the closed position within a hollow grip attached to the telescoping handle and including ventilation for drying.

15 Claims, 8 Drawing Sheets

COMPACT COLLAPSIBLE SQUEEGEE

CROSS-REFERENCE TO RELATED APPLICATIONS

This application claims the benefit under 35 U.S.C. §119 (e) of the following U.S. provisional patent application, which is incorporated by reference herein:

U.S. Provisional Patent Application No. 60/710,681, filed Aug. 23, 2005, by Randy Argo, entitled "COMPACT SQUEEGEE".

BACKGROUND OF THE INVENTION

1. Field of the Invention

This invention relates to convenience devices for wiping liquid off smooth surfaces. Particularly, this invention relates to squeegee devices for wiping fluid from washed windows, such as those of an automobile.

2. Description of the Related Art

Conventional squeegees are well known devices commonly used to clean large planar surfaces such as glass windows. A conventional squeegee typically comprises an elongated handle section with a rubber blade carrier perpendicularly fixed at its midpoint to one end of the elongated handle. A rubber blade is mounted in the blade carrier with an edge facing to one side of the rubber blade carrier. A sponge scrubber, typically comprising a sponge wrapped in nylon netting, is often fixed on the opposite side of the rubber blade carrier. In use, washing fluid is dispensed onto a large smooth glass surface. In some cases the washing fluid may be dispensed by dipping the sponge scrubber into washing fluid to be absorbed into the sponge. The handle of the squeegee is then manipulated to scrub the glass and loosen any sticking debris (such as dead insects) or dirt with the washing fluid using the sponge scrubber. Finally, the head of the squeegee is flipped over to wipe the washing fluid cleanly from the glass carrying away all the debris and dirt and leaving the glass clean.

Some filling stations may provide a squeegee and washing fluid so that motorist can clean their windows while they are refueling their cars. However, providing the proper supplies for a patron to clean his windows is not a priority so just as often such supplies will be absent. Fortunately, most cars incorporate a window washing system that dispenses washer fluid onto the front windshield (as well as the back window in some cases). While this system is adequate to clean the front (and sometimes rear) window well enough to improve driver visibility while the vehicle is in motion, it is not capable of removing all caked on debris and dirt and does not operate on side windows. In addition, the blades in the on board system move in a fixed pattern leaving unwashed areas. Thus, washing fluid from the on board reservoir can be loaded into the sponge scrubber as it is sprayed from the on board reservoir to be used to completely clean all the windows with a squeegee.

Alternately, a squeegee can be kept in the vehicle and used when there is none available. However, a conventional automotive squeegee is relatively bulky. A long handle is necessary to adequately reach the front windshield center from the side of the vehicle and the fixed perpendicular blade carrier coupled to that makes it difficult to find a place within most vehicles to easily store a squeegee. In addition, after using such a squeegee the sponge scrubber remains wet adding another difficulty to storing a squeegee in a car. Some attempts to make a less bulky squeegee have been made.

U.S. Pat. No. 4,339,838 by Pekarek, issued Jul. 20, 1982, discloses a squeegee having a retractable blade. One embodiment provides a handless squeegee having a retractable blade. Alternate embodiments provide a squeegee having both a foldable handle and a retractable blade. With each of the embodiments, a blade holder and blade are moveably positioned in the interior of a blade housing. An elongated opening is provided through the upper surface of the blade housing for extending and retracting the blade. Mechanical means are provided for moving the blade holder in the interior of the blade housing when it is desired to either extend or retract the blade.

However, the squeegee taught by Pekarek in one embodiment uses no perpendicular handle and in another incorporates a folding handle that is limited in length to half the width of the blade carrier. Accordingly, the squeegee of Pekarek is not easily used on front automotive windshields because the squeegee reach is limited. Furthermore, the squeegee of Pekarek does not include a sponge scrubber, so the problem of a wet scrubber to be stored is not addressed.

In view of the foregoing, there is a need in the art for squeegee devices providing a compact design so that they may be conveniently stored in a vehicle. In addition, there is further a need in the art for such devices to provide a long handle for reaching across an automotive windshield. There is also a need for such devices to be quickly stored without wetting the car interior. As detailed hereafter, these and other needs are met by the present invention.

SUMMARY OF THE INVENTION

A compact squeegee for wiping fluids from smooth surfaces including a telescoping handle having a hinged joint at one end and a wiper support attached to the hinged joint to pivot from a closed position with the wiper support substantially parallel to the telescoping handle to an open position with the wiper support substantially perpendicular to the telescoping handle. Latches may be used to secure both the telescoping handle and the wiper support in the open position such that the squeegee is substantially rigid in use. Both the telescoping handle and the hinged joint may be spring-loaded to automate deployment of the squeegee to the open position. The telescoping handle and wiper support may be stored in the closed position within a hollow grip attached to the telescoping handle and including ventilation for drying.

The compact collapsible squeegee may be a two-sided squeegee with a standard windshield wiper blade on one side and a scrubbing pad on the other attached to a handle including a grip and telescoping extension for compact storage. The squeegee head may include an elongated channel in which a window-cleaning scrubber is positioned and secured by a clamping or locking mechanism. The opposite side of the head may incorporate a standard windshield wiper blade that is held in place by an appropriate securing means including a clamping and/or locking mechanism. In use, the scrubber is moved back and forth across a window or smooth surface to loosen any debris and the blade side is moved across the surface to remove the cleaning solution and debris. The squeegee design may be extremely compact allowing storage in a bag, tube or other storing case, placed in a convenient storing location within a vehicle or other location for ready use.

A typical embodiment of the invention comprises a collapsible squeegee, including a telescoping handle having a hinged joint at one end and a wiper support attached to the hinged joint to pivot from a closed position with the wiper support substantially parallel to the telescoping handle to an open position with the wiper support substantially perpendicular to the telescoping handle.

A releasable wiper support latch may be used to secure the wiper support in the open position. In some embodiments, a torsion spring may be employed at the hinged joint to force the wiper support to the open position (e.g. so that the releasable wiper support latch will catch automatically when the wiper is deployed). The releasable wiper support latch may be released by pressing the latch in order to allow a user to place the wiper support in the closed position.

Embodiments of the invention may also employ one or more releasable telescoping handle latches for securing the telescoping handle in an extended position. The one or more releasable telescoping handle latches may be designed so that they are releasable merely by applying hand force to an end of the telescoping hand. In this way, it is unnecessary to release each latch for each section of the telescoping handle.

Conveniently, embodiments of the invention may further employ a grip such that the one or more telescoping sections are coupled in series with the grip at one end and the wiper support at another end. The grip may include a hollow section such that the one or more telescoping sections and the wiper support slide into the hollow section of the grip in the closed position. In addition, the grip may include a hollow section for storing one or more spare wiper blades. Embodiments of the invention may obtain a more compact form when closed if the one or more telescoping sections comprise an interlocking c-channel and the hinged joint slides through an open side of the interlocking c-channel. The grip may also include one or more venting holes for drying the wiper support inside the hollow section.

In some embodiments, the wiper support comprises a pair of swiveling wiper blade carriers each having a pair of guides for capturing opposing grooves of a standard automotive wiper blade. Embodiments of the invention may be designed to utilize a standard automotive wiper blade having a clip to capture the standard automotive wiper blade within the wiper support, e.g. within one end of one of the swiveling wiper blade carriers.

A scrubber may also be attached to a side of the wiper support opposite an installed wiper blade. The scrubber may be attached with a clip having a rough surface to hold the scrubber securely to the wiper support.

BRIEF DESCRIPTION OF THE DRAWINGS

Referring now to the drawings in which like reference numbers represent corresponding parts throughout.

DETAILED DESCRIPTION OF THE PREFERRED EMBODIMENT

1. Overview

Figure 1A:
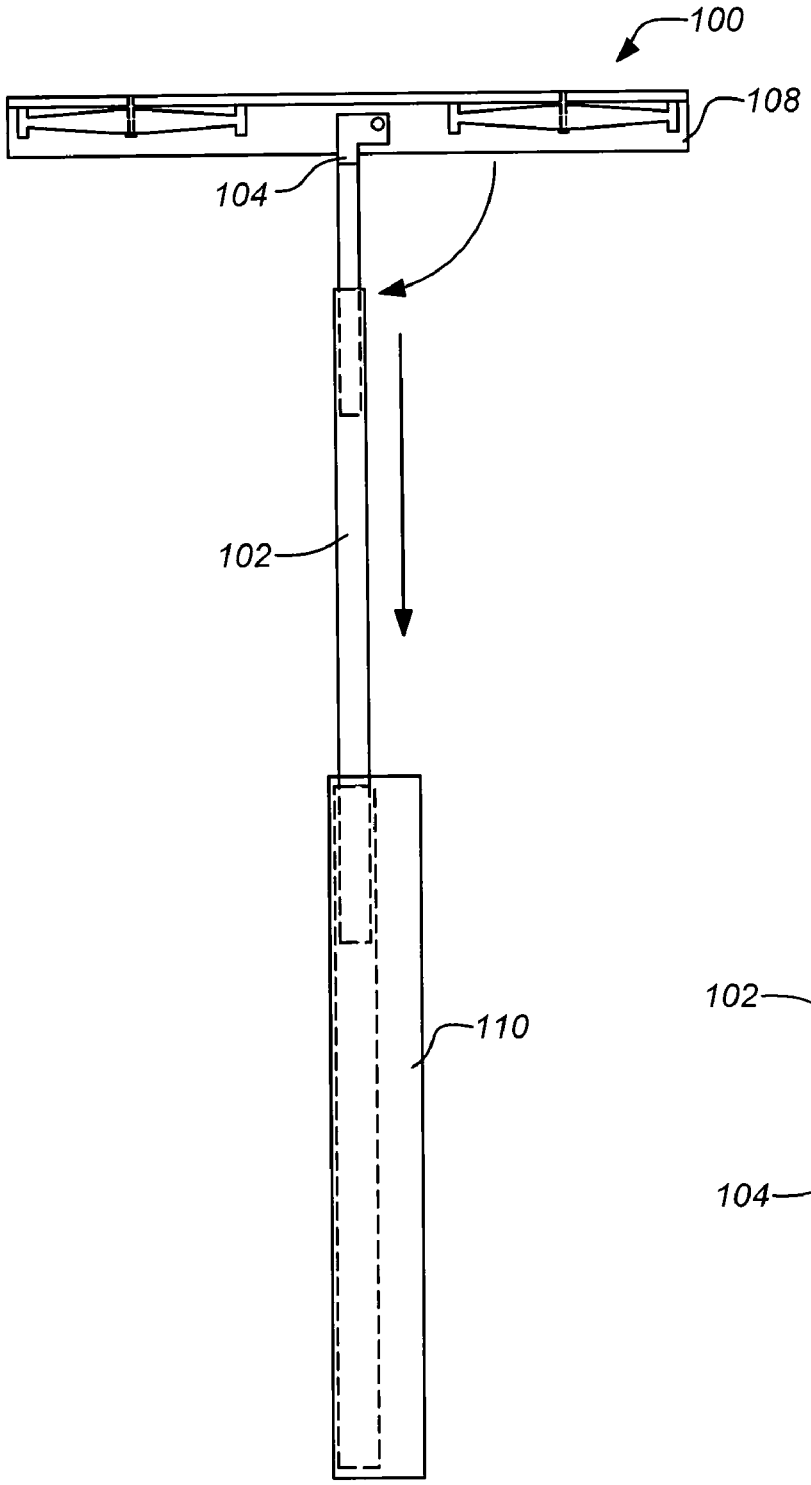
FIG. 1A illustrates an exemplary embodiment of a compact collapsible squeegee in an open and extended position according to the invention.

As previously mentioned, embodiments of the present invention are directed to a novel compact collapsible squeegee. Embodiments of the invention may incorporate a handle having a cylindrical outer casing with an extension that telescopes up and out from inside of the outer casing. However, the handle may also be square, oval or any other shape. At the end of the telescoping extension is a swivel head that can include wiper blade support for a standard wiper blade on one side and a sponge scrubber on the other side. The outer casing, which is used as a grip and held by the operator in use, houses and stores the telescoping extension and head of the squeegee when the squeegee is stored.

The head can lock into a perpendicular position by a latching mechanism to keep the head from swiveling during use. When unlatched, the head can fold down so that it is parallel to the telescoping extension. When folded, the telescoping extension and head are narrower than the grip so they can slide together into the grip. A pivot or hinge connects the squeegee head to the telescoping extension and the squeegee head is attached in such a way as to allow the head to pivot and slide into the grip for storage.

One side of the head includes the wiper blade support. The wiper blade support may be sized to hold a standard windshield wiper blade in place with a channel or groove that captures the grooves of the blade itself. The wiper blade support may also employ a locking clip that comes with most standard replacement wiper blades. The opposite side of the head contains a scrubber of appropriate material for scrubbing debris and dirt from a glass surface. The scrubber may be a removable strip of material that can be replaced as needed held in place by an interference fit material, such as a rough surface that grabs into the fibers of the scrubber or other means.

The specific shape and size of a wiper embodiment of the invention may vary without departing from the scope of the invention. For example, the telescoping handle may have a circular or polygonal cross section or any other shape. Furthermore, any size wiper may be developed, provided it is capable of collapsing from a longer size to a smaller compact form for storage as described herein.

In some embodiments, a plurality of adjacently engaged telescoping sections may be used in which each section includes an extending means adjacent to a next for extending each of the sections so that the squeegee handle can obtain a greatly extended length. The adjacent telescoping sections may be captured within each other when the squeegee is extended. When the squeegee is extended, a user slides a portion nearest the squeegee grip outwardly along a telescoping means and extends the post to a maximum length of a telescoping section, then pivots the head to a perpendicular position centered on the post. Exemplary embodiments of the invention are detailed hereafter.

It should also be noted that although described herein with respect to automotive applications, embodiments of the invention are not limited to such applications. Embodiments of the invention can be utilized to clean any glass or smooth surface.

2. Compact Collapsible Squeegee

Figure 1B:
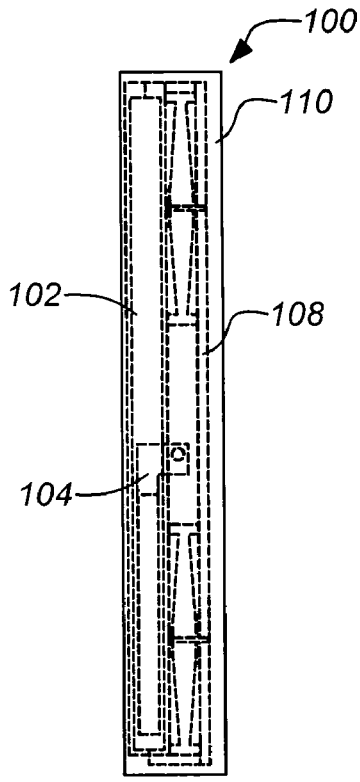
FIG. 1B illustrates an exemplary embodiment of a compact collapsible squeegee in an closed and retracted position according to the invention.

FIGS. 1A and 1B illustrate an exemplary embodiment of a compact collapsible squeegee 100 in an open and extended position and a closed and retracted position, respectively, according to the invention. The collapsible squeegee 100 uses a telescoping handle 102 having a hinged joint 104 at one end and a wiper support 108 attached to the hinged joint 104 to pivot between a closed position, with the wiper support 108 substantially parallel to the telescoping handle 102, and an open position, with the wiper support 108 substantially perpendicular to the telescoping handle 102.

The telescoping handle 102 is used to achieve a sufficiently long reach so that a user can easily clean smooth surfaces at a distance (such as the center of a car windshield from the side of the vehicle) and so the squeegee can be stored in a compact form when not in use. Accordingly, the telescoping handle 102 can incorporate one or more telescoping sections that slide relative to each other to deploy the head (with the wiper support 108) to an extended position from a retracted position. The sliding action between the distinct telescoping sections can be achieved by nested hollow cylinders, sliding screw-in sections captured in a channel, interlocking channeled sections, open c-channels or any other shape, interlocking rails, or any other suitable sliding mechanism known in the art for enabling the telescoping motion of the handle 102.

As an added feature, the telescoping handle 102 can also include a grip 110 such that the one or more telescoping sections are coupled in series with the grip at one end and the wiper support attached at the opposite end. The grip may have a significantly larger cross section than the telescoping sections so that it can be readily held and manipulated by a user. Furthermore, in one notable embodiment, the grip may include a hollow section such that the one or more telescoping sections and the wiper support slide into the hollow section of the grip in the closed position as shown in FIG. 1B.

Figure 2A:
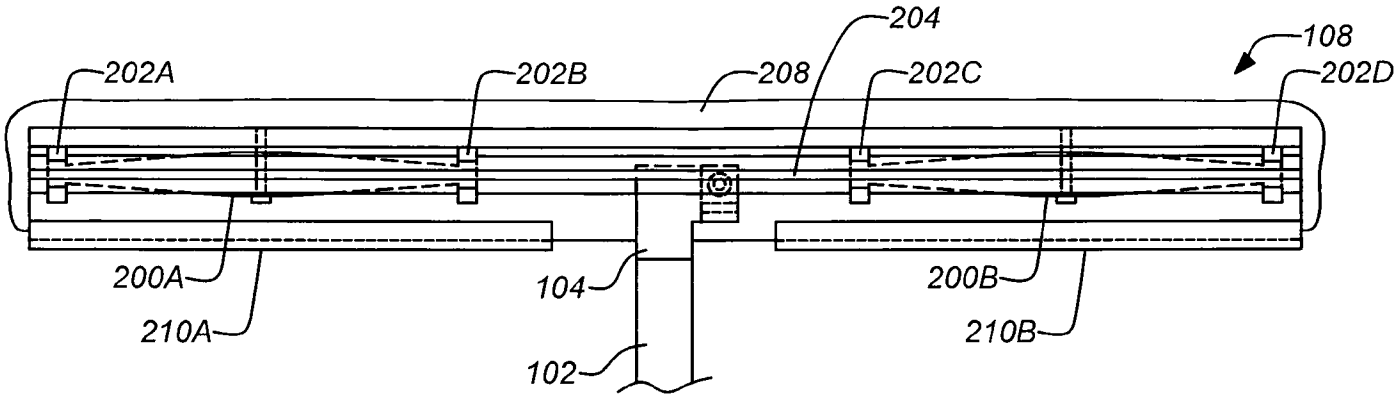
FIGS. 2A-2C illustrate front, top and side detailed views of a wiper support for an exemplary embodiment of a compact collapsible squeegee according to the invention.
Figure 2B:
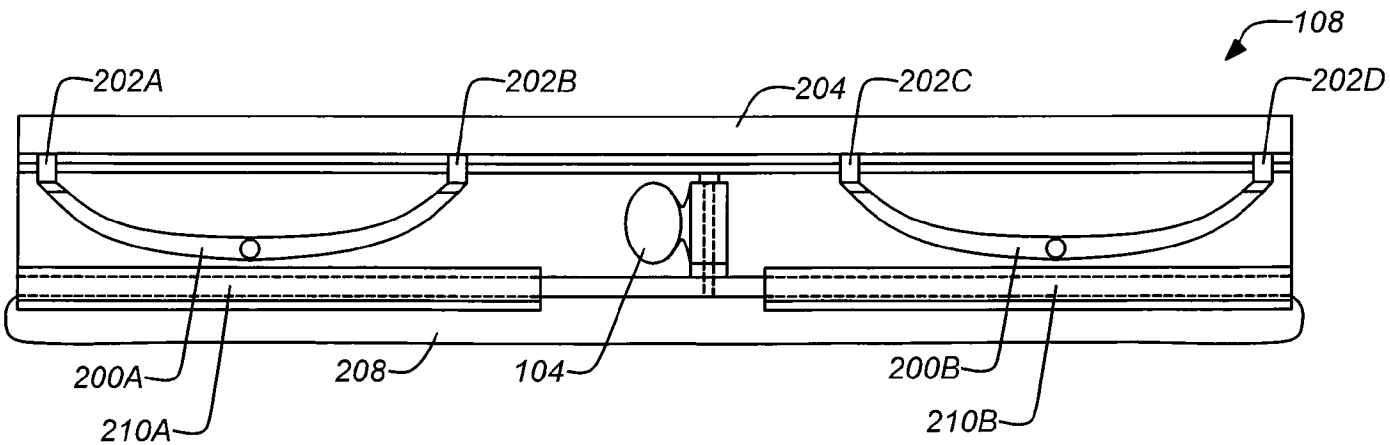
Figure 2C:
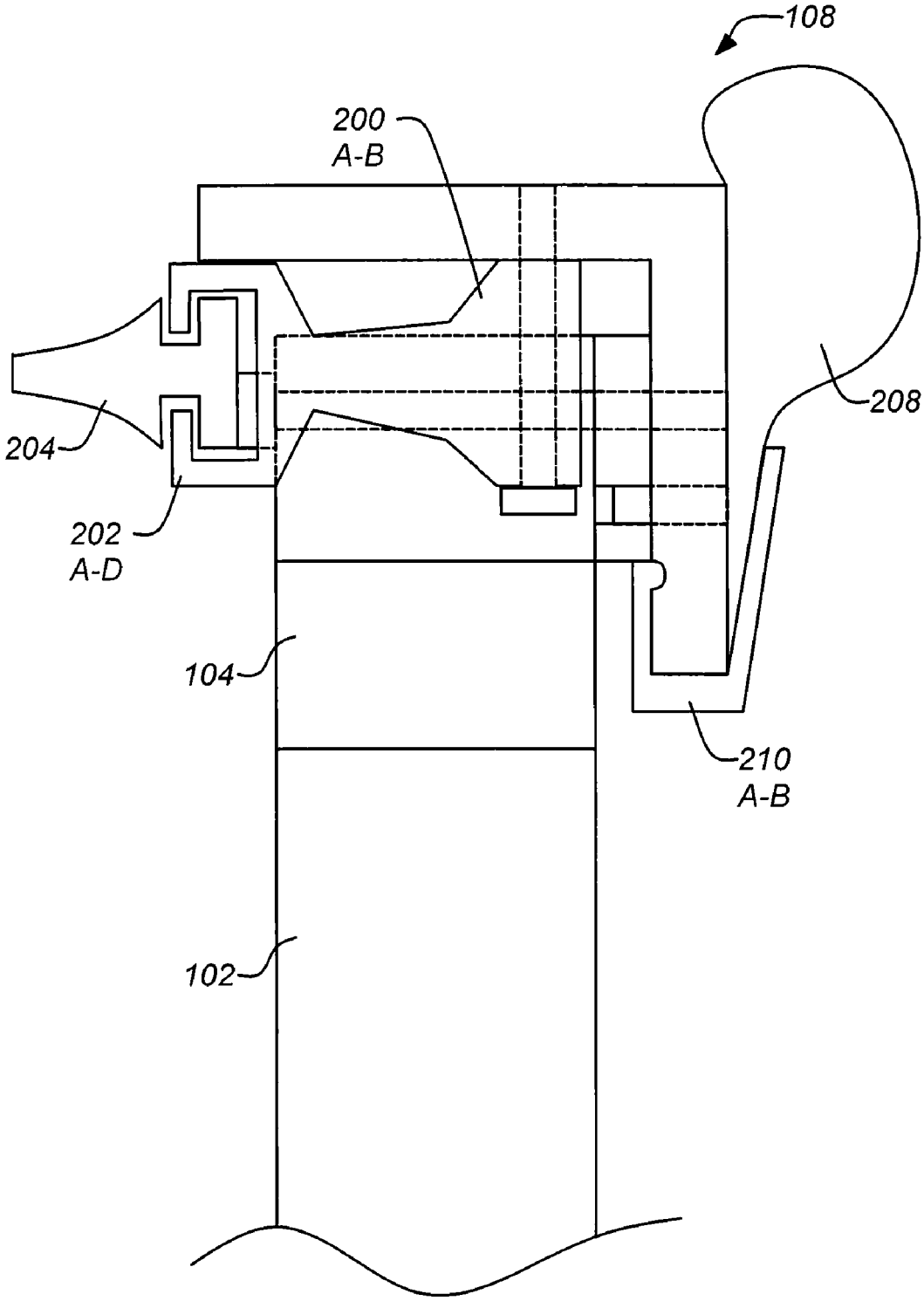

FIGS. 2A-2C illustrate front, top and side detailed views, respectively, of the wiper support 108 for an exemplary embodiment of a compact collapsible squeegee according to the invention. The wiper support 108 includes a pair of swiveling wiper blade carriers 200A, 200B, each having a pair of guides 202A, 202B, 202C, 202D for capturing opposing grooves of a standard automotive wiper blade 204. The swiveling wiper blade carriers 200A, 200B are each attached to the wiper support 108 at central pivots to swivel independently, allowing the wiper blade 204 to form to the potentially curved surface (e.g. of a windshield) that is being wiped clean. Alternately, a fixed wiper blade (completely attached to the wiper support 108 along a back edge of the blade) or any other suitable type of known wiper blade design may also be used with an embodiment of the invention. Although a non-swiveling wiper blade may not form well to curved surfaces, a more compact storage form may be achieved overall as the wiper support may be reduced in size. The standard automotive wiper blade 204 can utilize a clip 206 disposed at one end to grasp one end of one of the swiveling wiper blade carriers and capture the wiper blade within the wiper support 108.

A scrubber 208 may also be attached to a side of the wiper support 108 opposite an installed wiper blade 204, enabling a user to readily switch back and forth between the scrubber 208 and the wiper blade 204 by flipping the wiper support 108 over in use. The scrubber 208 may be attached with one or more clips 210A, 210B. In one example, the clips 210A, 210B may be designed to snap into a feature in the surface of the wiper support 108. Alternately, screws, an interference fit, a c-channel or any other suitable form of removable and replaceable attachment mechanism known in the art for holding the scrubber 208 to the wiper support 108 along an edge may be employed. The clips 210A, 210B may have a rough surface on the sides facing the scrubber 208 to better hold the scrubber securely to the wiper support 108.

Figure 2D:
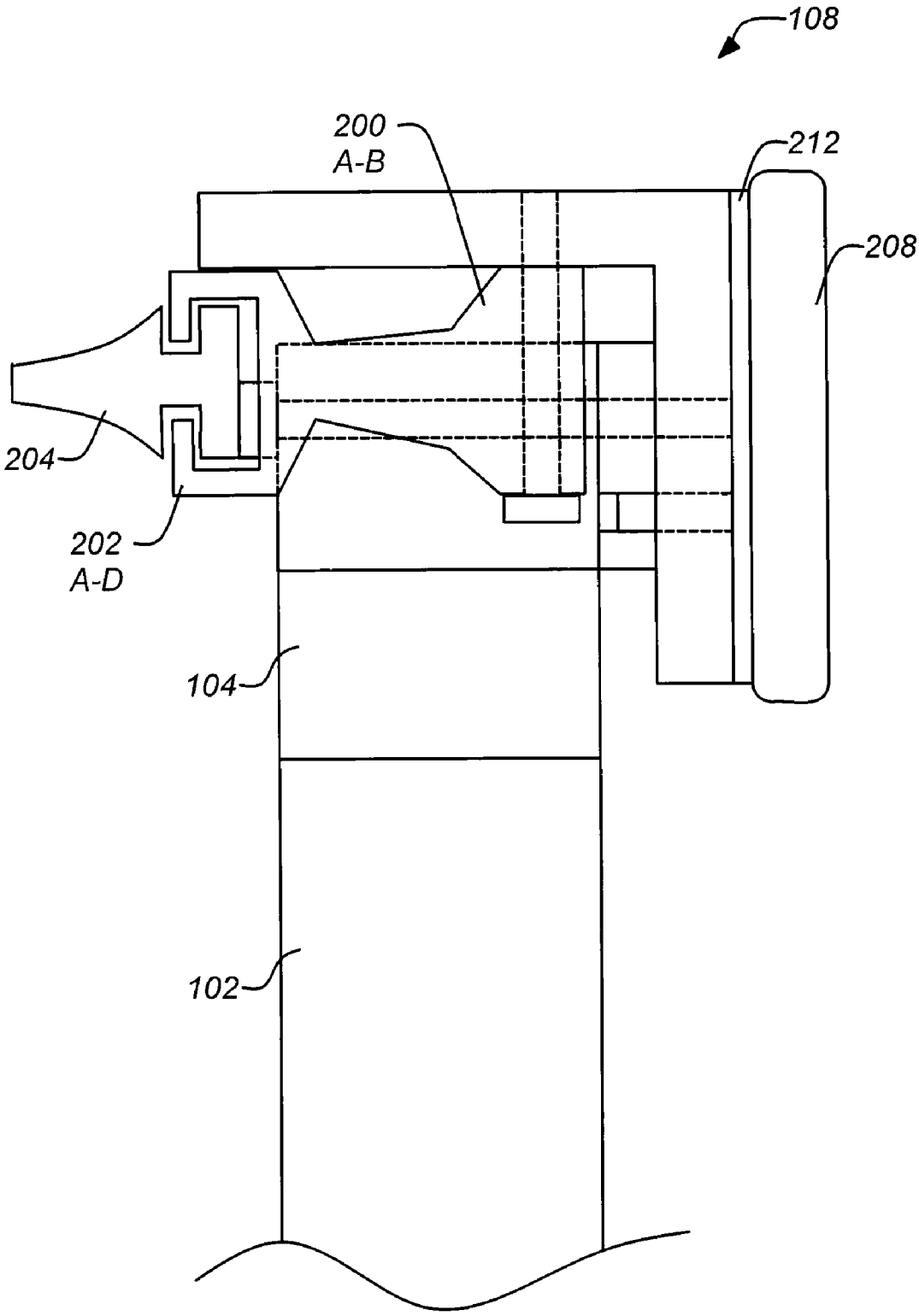
FIG. 2D illustrates a side detailed view of a wiper support using an alternate scrubber configuration for an exemplary embodiment of a compact collapsible squeegee according to the invention.

FIG. 2D illustrates a side detailed view of a wiper support using an alternate scrubber configuration for an exemplary embodiment of a compact collapsible squeegee according to the invention. In this example, the scrubber 208 is configured as a flat pad shape and is attached to the back surface of the wiper support 108 through a hook-and-loop interface 212 (e.g., such as Velcro®). The hook-and-loop interface may be implemented through an applied adhesive strip of one component (e.g. the hook side) to the wiper support 108 and the matching component (e.g. the loop side) applied to the scrubber 208. The hook side may alternately be placed on the pad and loop side on the wiper support 108. In addition, the scrubber material may be selected so that it has an inherent property (of a hook or loop component) such that it is naturally held when applied to the wiper support 108. For example, the scrubber may have a fabric surface (comprising small loops) that are naturally caught by the hook surface of the wiper support 108 back. Similarly, the wiper support 108 surface may be produced so that it obtains the property of one part of the a hook-and-loop interface 212. For example, if the wiper support 108 is specially machined to have a knurled surface type, small burrs on the surface may act as a hook surface, sufficient to capture a loop surface of a scrubber 208.

Figure 3A:
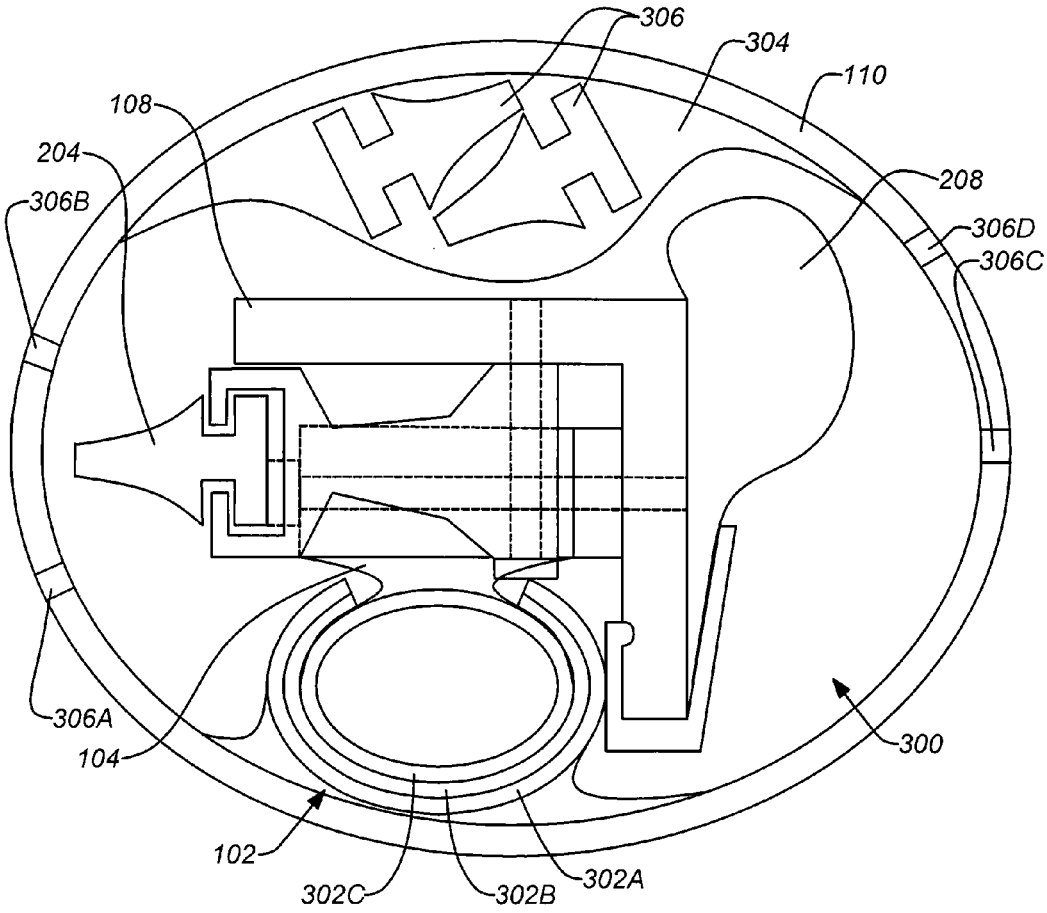
FIG. 3A illustrates an exemplary embodiment of a compact collapsible squeegee with a clipped scrubber held within a hollow grip of the telescoping handle according to the invention.
Figure 3B:
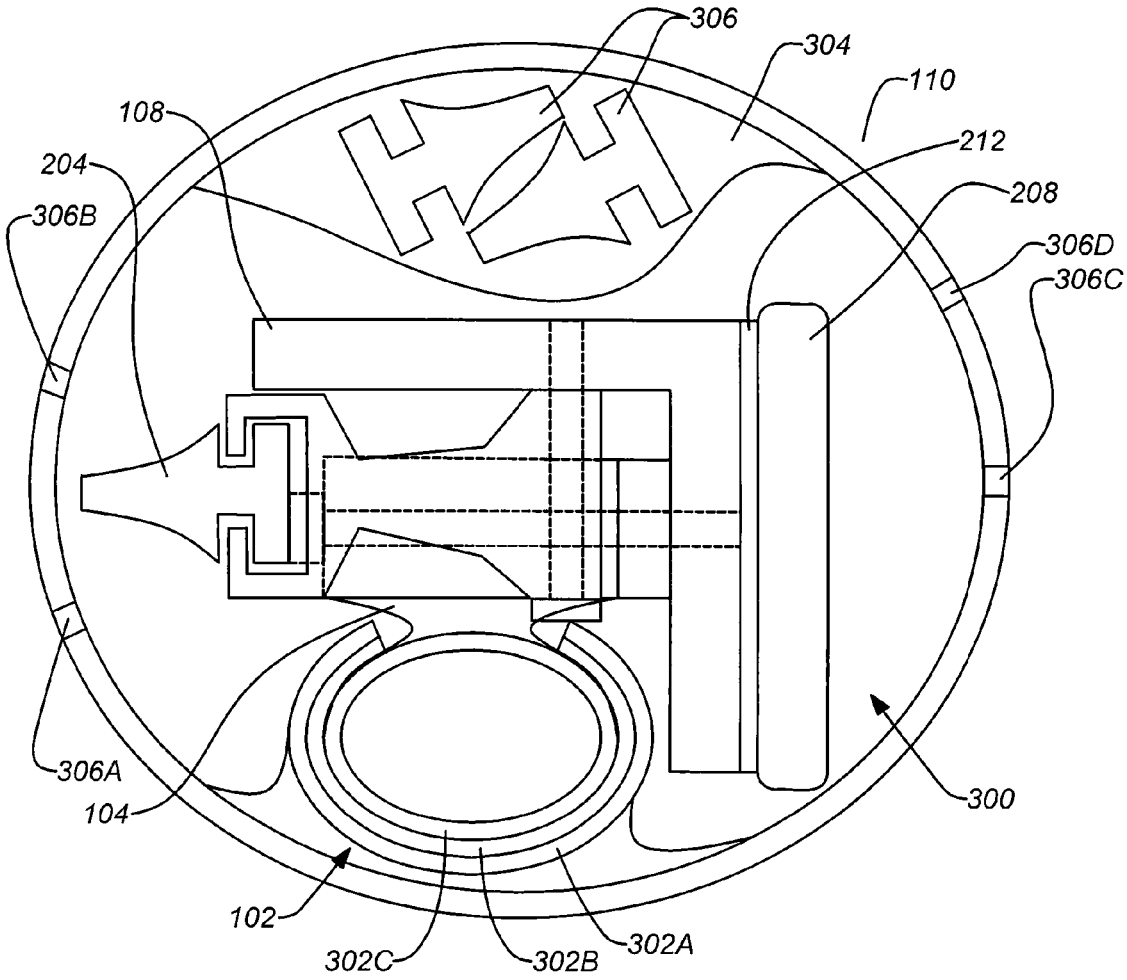
FIG. 3B illustrates an exemplary embodiment of a compact collapsible squeegee with a pad scrubber held within a hollow grip of the telescoping handle according to the invention.

Regardless of the attachment means (FIG. 2C, 2D or any other suitable type), the scrubber 208 may be made of any appropriate material(s) know in the art. Further, the scrubber 208 may be configured in any suitable shape. In some embodiments, the scrubber may not use a sponge, but may instead use a thin cushioned non-absorbing material or pad if any cushion is used at all, to better remove debris from the surface being cleaned. In other embodiments, a sponge wrapped in nylon webbing may be used or any other material suitable for carrying liquid washing fluid and scrubbing debris and dirt from a glass surface. The example scrubber 208 shown in FIGS. 2C and 3A is shown configured with a teardrop cross section with one edge pressed under the clips 210A, 210B so that the large side of the teardrop shape is used to scrub. The example scrubber 208 shown in FIGS. 2D and 3B is shown configured as a flat pad held in place with a hook-and-loop interface so that the flat side of the pad shape is used to scrub. Any suitable alternate shape or combination of these two example configurations may also be employed with an embodiment of the invention.

FIG. 3A illustrates an exemplary embodiment of a compact collapsible squeegee 100 with a clipped scrubber 108 held within a hollow section 300 of a grip 110 of the telescoping handle 102 according to the invention. The outermost telescoping section 302A is fixed to an interior wall of the hollow section 300. The innermost telescoping section 302C is fixed to the hinged joint 104. Any intervening sections 302B (which may be none, one or a multiple) providing a sliding engagement between the sections 302A and 302C. As shown, the telescoping sections 302A-302C of the telescoping handle 102 comprise nested interlocking c-channels open in the same direction. This form of sliding engagement allows the hinged joint 104 extending to one side to slide past the ends of all the telescoping sections as shown in FIG. 1B through an open side of the interlocking c-channel, thus enabling a very compact form when the squeeged is fully retracted.

The grip 110 may also incorporate other convenient features. For example, the grip 110 may include a separate hollow section 304 within it for storing one or more spare wiper blades 306 as replacements for the installed wiper blade 204. Similarly, the grip 110 may incorporate other hollow sections in place of or in addition to the wiper blade hollow section 302 to store other items, e.g. such as a spare scrubber. The grip 110 may also include one or more venting holes 306A-306D for drying the wiper support (including the wiper blade 204 and/or scrubber 208) while inside the hollow section of the grip 110.

FIG. 3B illustrates an exemplary embodiment of a compact collapsible squeegee with a pad scrubber 108 held within a hollow grip 110 of the telescoping handle according to the invention. This example embodiment of the invention operates in the same manner as the other embodiment described. Configuring the scrubber 208 as a pad as shown, however, allows for a smaller overall configuration to be stored within the grip 110 because the scrubber is not as bulky.

Figure 4A:
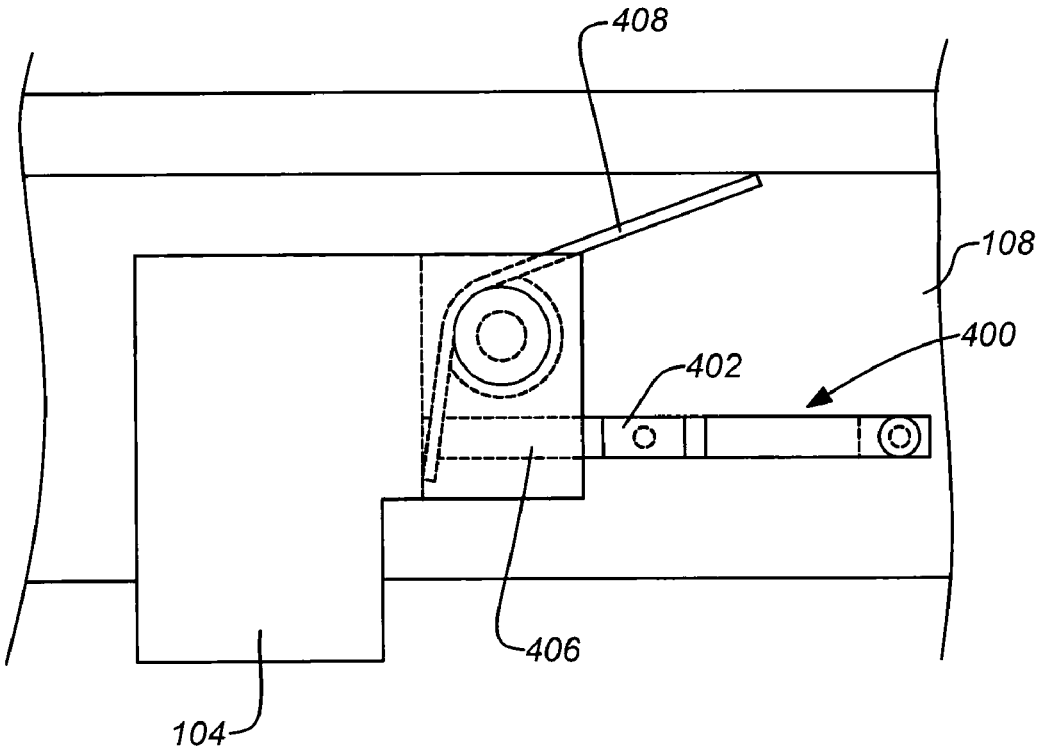
FIGS. 4A and 4B illustrate a hinged joint and latch for an exemplary embodiment of a compact collapsible squeegee according to the invention.
Figure 4B:
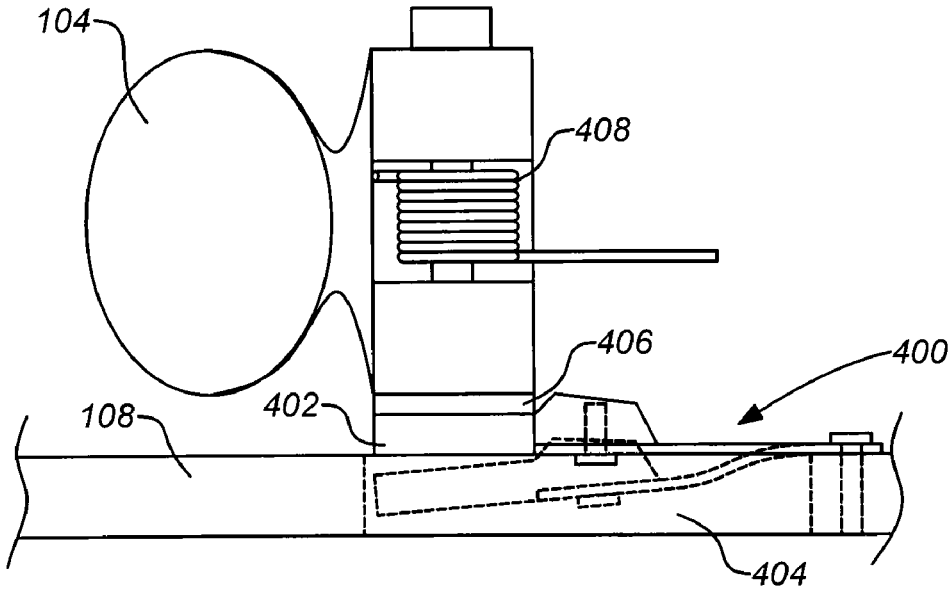

FIGS. 4A and 4B illustrate detailed top and front views of a hinged joint 104 and latch 400 for an exemplary embodiment of a compact collapsible squeegee according to the invention. The releasable wiper support latch 400 may be used to secure the wiper support 108 in the open position. This allows a user to operate the squeegee in a stable configuration without the wiper support 108 swiveling around. In the example shown, the latch 400 comprises a beam 402 within a slot 404 of the wiper support 108 and spring loaded towards the hinged joint 104, e.g. on a cantilever spring. The hinged joint 104 also has a slot 406 (or at least one edge) that becomes aligned with the beam 402 so that it can slide into the slot 406 and latch when the wiper support 108 is in the open position. Thus, the hinged joint 104 automatically becomes latched when the wiper support 108 is placed in the open position.

When the user wishes to close the squeegee, the releasable wiper support latch 400 may be released by pressing the latch 400 out of the slot 406 (as shown by the dotted outline of the latch 400 in FIG. 4B) to allow the hinged joint 104 to rotate so that the wiper support 108 can be placed in the closed position. In some embodiments, a torsion spring 408 may be employed at the hinged joint to force the wiper support to the open position so that the releasable wiper support latch 400 will catch automatically when the wiper is deployed. The torsion spring 408 may be disposed around the pivot of the hinged joint 104 with one arm braced against the hinged joint and another against the wiper support 108. Alternately, embodiments of the invention may employ any other type of suitable latching mechanism for automatically catching and holding the wiper support in an open position that can be manually released by a user.

Figure 5:
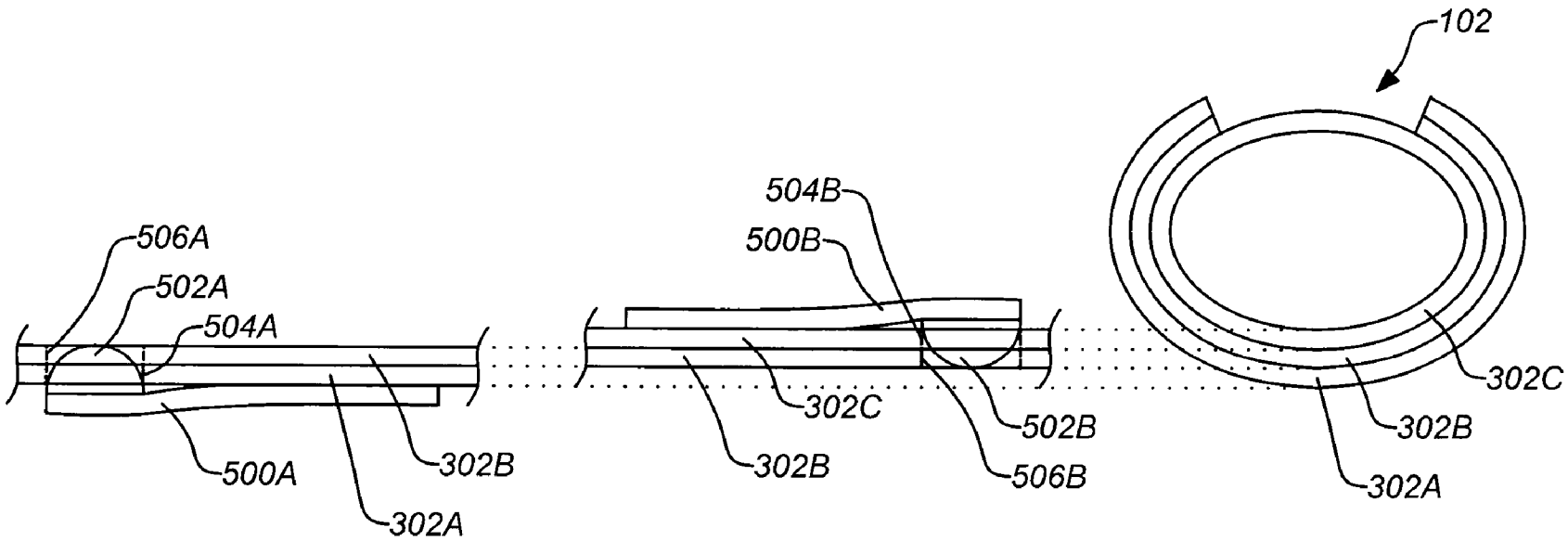
FIG. 5 illustrates telescoping sections and latches for an exemplary embodiment of a compact collapsible squeegee according to the invention.

FIG. 5 illustrates telescoping sections and latches for an exemplary embodiment of a compact collapsible squeegee according to the invention. One or more releasable telescoping handle latches 500A, 500B may be used for securing the telescoping handle in an extended position. The releasable telescoping handle latches 500A, 500B may be designed so that they are releasable merely by applying hand force to an end of the telescoping hand. In this way, it is unnecessary to release each latch for each section of the telescoping handle.

For example, each of the releasable telescoping handle latches 500A, 500B may be a cantilever spring having a hemispherical button 502A, 502B pushing through a hole 504A, 504B in an attached telescoping section 302A, 302C. The cantilevered spring of the latches 500A, 500B may be spot welded to the attached telescoping section 302A, 302C, respectively. When the telescoping handle is extended to the proper position the button engages the proper hole 506A, 506B in the adjacent telescoping section 302B. Note that the latch holes 504A, 504B, 506A, 506B stay aligned if an asymmetric cross section is used for the telescoping sections, e.g. the oval c-channels, so that the telescoping sections cannot rotate relative to each other.

The button shape, spring force and holes can be sized together to strike a balance so that enough retention force is maintained to use the squeegee without the telescoping handle collapsing, but the handle may be collapsed from firm pressure applied along the line of the handle at the wiper support 108 towards the grip 110. The round shape of the hemispherical button 502, 502B pushing through the hole 506A, 506B allows the sliding action of telescoping section 302B relative to telescoping sections 302A and 302C to help push the button inward and release the latch 500A, 500B if enough force is applied. Alternately, the button may have a wedge shape or any other suitable shape that allows some of the sliding action between the telescoping sections to assist in releasing the latches 500A, 500B. Fortunately, because a side pressure is applied when the squeegee is used this tends to make the telescoping handle almost self-locking, so that a minimal amount of retention force at the latches 500A, 500B to adequately hold the telescoping handle in use.

Embodiments of the invention may alternately employ any other type of suitable latching mechanism for automatically catching and holding adjacent telescoping sections in an extended position that can be easily released by a user. For example, although less convenient, latches that must be manually released by a user to collapse the telescoping handle may also be employed.

This concludes the description including the preferred embodiments of the present invention. The foregoing description including the preferred embodiment of the invention has been presented for the purposes of illustration and description. It is not intended to be exhaustive or to limit the invention to the precise forms disclosed. Many modifications and variations are possible within the scope of the foregoing teachings. Additional variations of the present invention may be devised without departing from the inventive concept as set forth in the following claims.

What is claimed is:

1. A collapsible squeegee, comprising:

a telescoping handle having a hinged joint at one end;

a wiper support attached to the hinged joint to pivot from a closed position with the wiper support substantially parallel to the telescoping handle to an open position with the wiper support substantially perpendicular to the telescoping handle; and a torsion spring around a pivot of the hinged joint for forcing the wiper support from the closed position to the open position;

wherein the telescoping handle comprises a grip with one or more telescoping sections coupled in series between the grip at one end and the wiper support at another end and the grip includes a hollow section and the one or more telescoping sections and the wiper support slide inside, are completely surrounded by interior walls of the hollow section of the grip and are held within the hollow section in the closed position by sliding of the one or more telescoping sections and the one or more telescoping sections comprise an interlocking c-channel for providing sliding engagement between the one or more telescoping sections and the hinged joint slides through an open side of the interlocking c-channel to be completely surrounded by the interior walls of the hollow section of the grip and held within the hollow section in the closed position with the one or more telescoping sections and the wiper support.

2. The apparatus of claim 1, wherein the wiper support comprises a pair of swiveling wiper blade carriers each having a pair of guides for capturing opposing grooves of a standard automotive wiper blade.

3. The apparatus of claim 1, further comprising a scrubber attached to a side of the wiper support.

4. The apparatus of claim 3, wherein a scrubber is attached to the side of the wiper support with a clip having a rough surface to hold the scrubber securely to the wiper support.

5. The apparatus of claim 1, further comprising a standard automotive wiper blade having a clip to capture the standard automotive wiper blade within the wiper support.

6. The apparatus of claim 1, further comprising a releasable wiper support latch for securing the wiper support in the open position.

7. The apparatus of claim 1, further comprising one or more releasable telescoping handle latches for securing the telescoping handle in an extended position.

8. The apparatus of claim 7, wherein the one or more releasable telescoping handle latches are releasable by applying hand force to an end of the telescoping hand.

9. The apparatus of claim 1, wherein the grip includes a hollow section for storing one or more spare wiper blades.

10. The apparatus of claim 1, wherein the grip includes one or more venting holes for drying the wiper support inside the hollow section.

11. An apparatus, comprising:

a telescoping handle means for extending one end;

a wiper support means for supporting a wiper blade;

a hinged joint means attached to the telescoping handle means at the one end for pivoting the wiper support means from a closed position with the wiper support means substantially parallel to the telescoping handle means to an open position with the wiper support means substantially perpendicular to the telescoping handle means; and a torsion spring means around a pivot of the hinged joint means for forcing the wiper support means from the closed position to the open position;

wherein the telescoping handle means comprises a grip means for holding one or more telescoping sections of the telescoping handle means and the wiper support means in the closed position and the one or more telescoping sections and the wiper support slide inside, are completely surrounded by interior walls of a hollow section of the grip means and are held within the hollow section in the closed position by sliding of the one or more telescoping sections and the one or more telescoping sections comprise an interlocking c-channel for providing sliding engagement between the one or more telescoping sections and the hinged joint means slides through an open side of the interlocking c-channel to be completely surrounded by the interior walls of the hollow section of the grip means and held within the hollow section in the closed position with the one or more telescoping sections and the wiper support means.

12. The apparatus of claim 11, further comprising a releasable wiper support latch means for securing the wiper support means in the open position.

13. The apparatus of claim 11, further comprising a scrubbing means for scrubbing a surface attached to a side of the wiper support means.

14. The apparatus of claim 11, wherein the telescoping handle means comprises a storage section means for storing one or more spare wiper blades.

15. The apparatus of claim 11, wherein the grip includes one or more venting holes for drying the wiper support held inside.

* * * * *